United States Patent [19]

Mixon, Jr.

[11] Patent Number: 4,906,212

[45] Date of Patent: Mar. 6, 1990

[54] ELECTRICAL PIN AND SOCKET CONNECTOR

[75] Inventor: James L. Mixon, Jr., Harrisburg, Pa.

[73] Assignee: AMP Incorporated, Harrisburg, Pa.

[21] Appl. No.: 336,155

[22] Filed: Apr. 11, 1989

[51] Int. Cl.[4] ..... H01R 11/22

[52] U.S. Cl. ..... 439/857; 439/885

[58] Field of Search ..... 439/850–858, 439/668, 669, 677, 885, 877, 879, 874

[56] References Cited

U.S. PATENT DOCUMENTS

| | | | |
|---|---|---|---|
| 2,204,408 | 6/1940 | Folsom | 439/857 |
| 3,311,866 | 3/1964 | Williamson . | |
| 3,953,103 | 4/1976 | Mathis | 439/877 |
| 4,032,215 | 6/1977 | Jarmofsky et al. | 439/852 |
| 4,136,923 | 1/1979 | Spaulding | 439/852 |
| 4,168,878 | 9/1979 | Risser et al. . | |
| 4,776,651 | 10/1988 | Paulo . | |
| 4,795,379 | 1/1989 | Sasaki et al. | 439/856 |

FOREIGN PATENT DOCUMENTS

| | | | |
|---|---|---|---|
| 2512283 | 3/1983 | France | 439/852 |
| 1435587 | 5/1976 | United Kingdom | 439/851 |

OTHER PUBLICATIONS

"New Design Ideas" Brian Hogan, Sep. 1978, pp. 52–53.

*Primary Examiner*—David Pirlot

*Attorney, Agent, or Firm*—Allan B. Osborne

[57] ABSTRACT

An electrical socket and pin connector. More particularly, the socket and pin are made from conductive material by stamping and forming. The socket includes a cylindrical mating portion defined by cantilever beams having one or more blades and wherein some blades include a rearwardly extending free end. The pin includes a mating portion having a bullet nose at one end and a wire barrel at another end.

6 Claims, 4 Drawing Sheets

ELECTRICAL PIN AND SOCKET CONNECTOR

FIELD OF THE INVENTION

This invention relates to stamped and formed electrical pins and sockets which mate with each other.

BACKGROUND OF THE INVENTION

Electrical pin and socket connectors are well known in the prior art. For example, U.S. Pat. No. 3,311,866 discloses connectors made by stamping and forming wherein the pins and sockets are of generally straight tubular members made by rolling up a stamped blank. Normal forces are provided by a slightly oversized pin resiliently expanding the socket.

Although such pin and sockets are effective, efforts have been continuously made to produce even better stamped and formed pin and sockets on a more economical basis. Such efforts have produced the present invention.

SUMMARY OF THE INVENTION

According to the present invention, an electrical pin and socket connector made by stamping and forming is provided. The socket includes a receptacle portion defined by a plurality of axially extending resilient beams which having inwardly facing convex surfaces. A wire barrel is provided at an end opposite the receptacle portion. The pin includes a mating portion at one end for insertion into the receptacle portion and a wire barrel at the other end.

DESCRIPTION OF THE INVENTION

Figure 1:
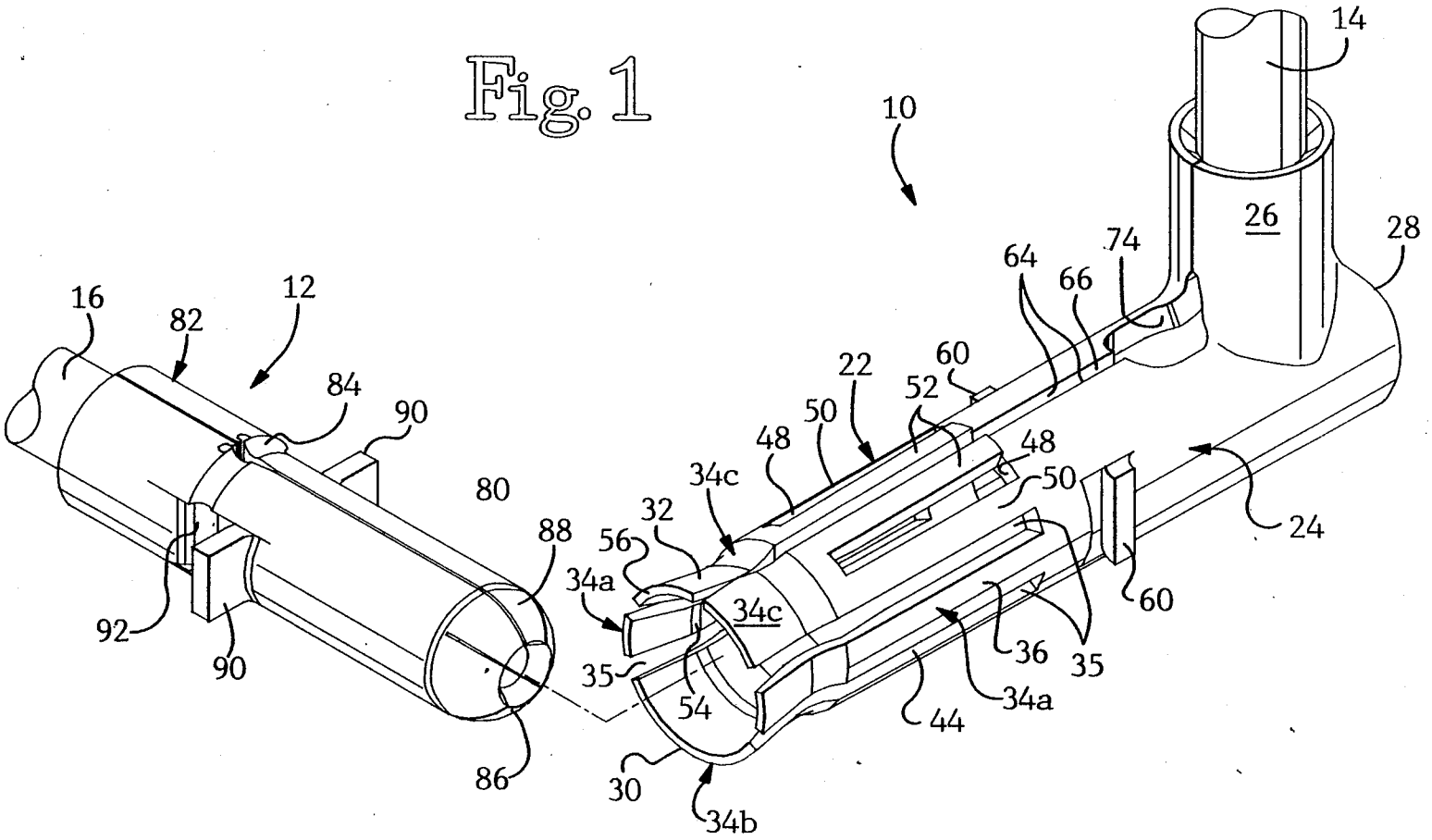
FIG. 1 is a perspective view of the stamped and formed pin and socket in accordance with the invention.
Figure 2:
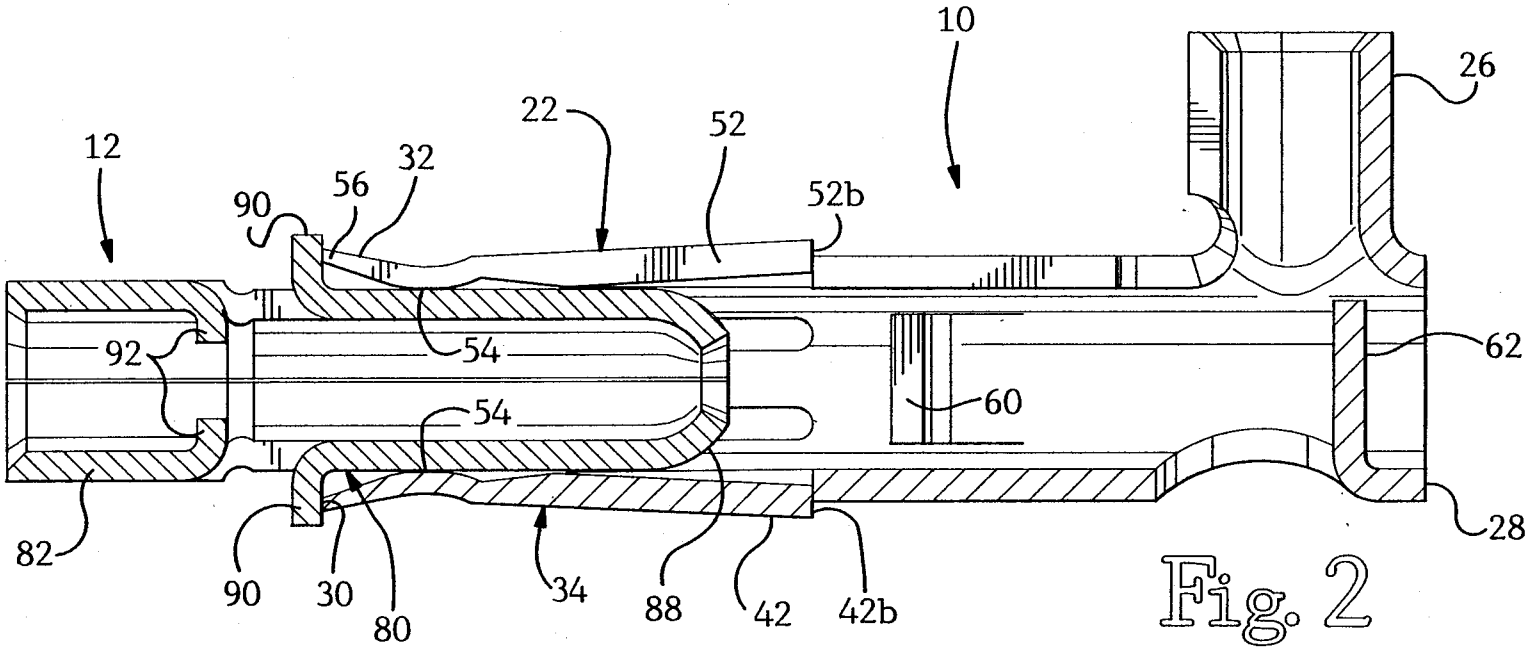
FIG. 2 is a sectional view of the pin received in the socket.

Contact socket 10 and contact pin 12 as shown in FIG. 1 are adapted to be telescopically engaged as shown in FIG. 2 to form a disengageable electrical connection between electrical wires 14,16 secured to socket 10 and pin 12 respectively. Socket 10 is formed from stamped-out flat blank 18, FIG. 3A and pin 12 is formed from stamped-out flat blank 20, FIG. 4A. Most of the parts of the respective blanks 18, 20 are identified by the same reference numerals as those used in the following descriptions of socket 10, pin 12 respectively.

With reference to FIGS. 1 and 2, socket 10 comprises a cylindrical receptacle portion 22 from which a cylindrical connecting section 24 extends rearwardly. A cylindrical wire barrel 26 projects outwardly normal to section 24 and is adjacent rear end 28 thereof. Front end 30 of socket 10 includes outwardly flared portion 32 to guide pin 12 into receptacle portion 22.

Receptacle portion 22 includes a plurality of beams 34 defined by slots 35 which are attached to connecting section 24 and terminate at front end 30 forming the aforementioned flared portion 32. As more clearly seen in FIG. 3A, beams 34 include two beams **34*a*, one beam 34*b* and two beams 34*c*. Beams 34*a* have a single blade 36. Beam 34*b* has a compound blade 38 with a pair of spaced-apart parallel slots 40 defining a blade center portion 42 and a pair of blade outer portions 44. Portions 42 and 44 merge beyond slots 40. As indicated by solid line 42*a*, center portion 42 is free of connecting section 24 to define free end 42*b* (FIG. 2) and as shown in FIG. 2 is displaced to project obliquely outwardly in a rearward direction. Beams 34*c* have a compound blade 46 with a single slot 48 defining blade portion 50 and narrow blade portion 52. Both blade portions 50,52 merge beyond slot 48. As with center portion 42, narrow blade portion 52 is severed from connecting section 24 as indicated by solid line 52*a* (FIG. 3B) to define free end 52*b*** (FIG. 2) and formed to project obliquely outwardly in the rearward direction.

As is more apparent in FIG. 2, beams 34, in flared portion 32, have a concavo-convex shape with convex surface 54 facing inwardly. As can also be seen in FIG. 2, free ends 56 of beams 34 have been thinned to provide matched entry of pin 12 to socket 10, and reduced outside diameter.

With respect to connecting section 24, a pair of ears 60 project outwardly from two oppositely-facing surfaces As shown in FIG. 2, wire stop 62 is provided to engage wire 14 inserted into wire barrel 26.

Socket 10 is formed by rolling edges 64 over to face each other with seam 66 therebetween. Wire barrel 26 is formed by bending the two blank flaps 68 (FIG. 3A) into arcuate shapes which cooperate to provide the full cylindrical shape upon the aforementioned rolling operation. The wire barrel forming step is facilitated by cut-outs 70–72 in blank 18, FIG. 3A. Cut-outs 70 provide opening 74 shown in FIG. 1 and cut-outs 72 provide similar opening (not shown) adjacent rear end 28.

Reference numeral 75 indicates a portion of the carrier strip which carries a given item; e.g., socket 10, through the various stamping and forming work stations (not shown). As is well known, the carrier strip is cut away at some point as required.

Figures 3A, 3B:
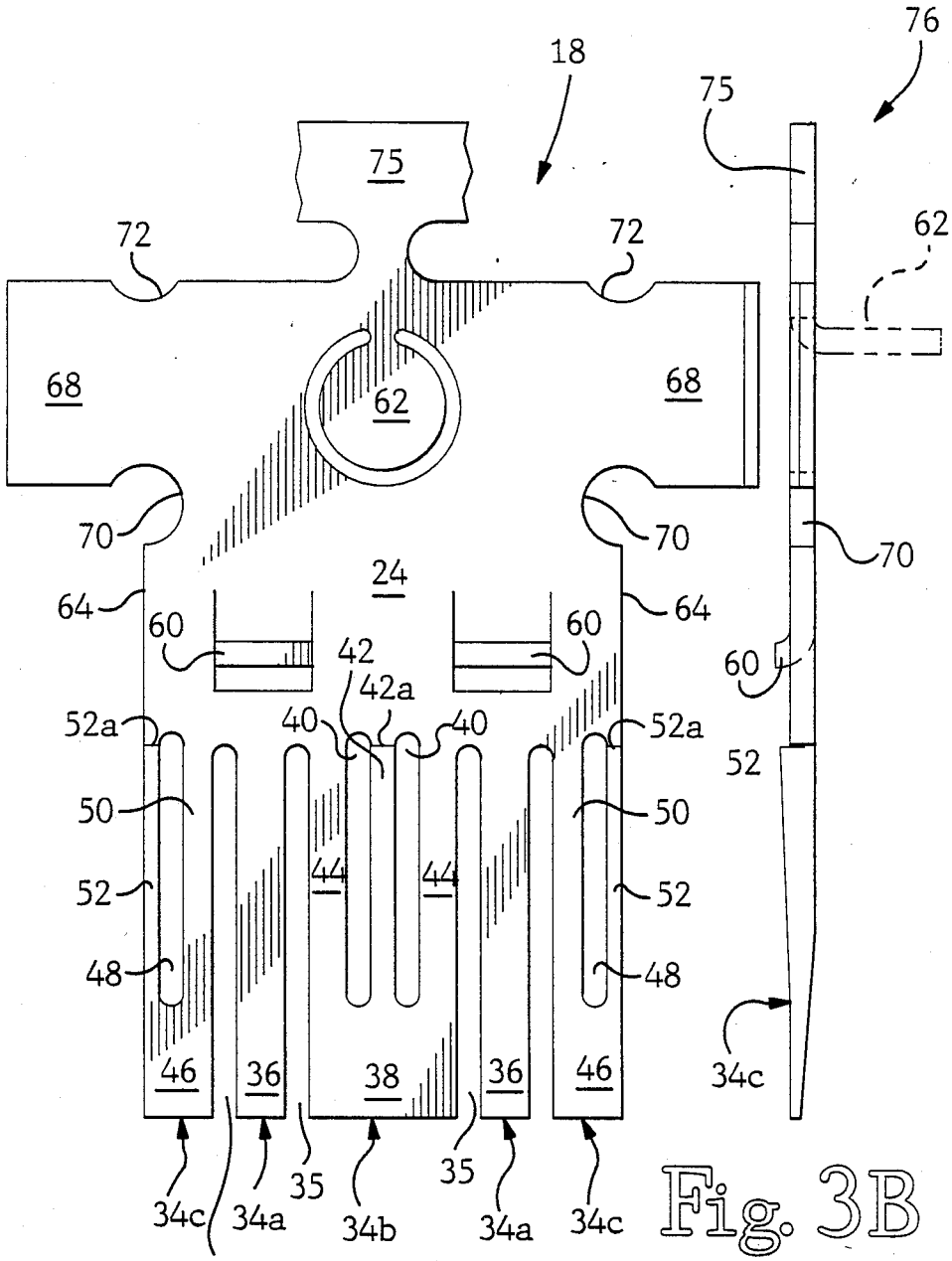
FIG. 3A is a plan view of the flat blank from which the socket of FIG. 1 is formed.
FIG. 3B is a side view of the blank of FIG. 3A.

FIG. 3B shows a partially formed blank 76 wherein blade portions 42 and 52 have been pushed to extend obliquely outwardly, wire stop 62 has been pushed to project outwardly at about a ninety degree angle relative to the blank and ears 60 also pushed out as shown. The final step is to roll blank 76 around to a cylindrical shape and form flaps 68 into an arcuate shape to form wire barrel 26 as shown in FIGS. 1 and 2.

With reference to FIGS. 1 and 2, contact pin 12 comprises a cylindrical mating portion 80 and coaxially thereto, wire barrel 82 which has a slightly greater diameter as is evident by shoulder 84. Front end 86 of portion 80 is provided with a bullet-shaped nose 88. A pair of ears 90, located just in front of shoulder 84, extend outwardly from opposite sides of mating portion 80. A pair of wire stops 92, extend into wire barrel 82 from opposite sides as shown more clearly in FIG. 2.

Figure 4A:
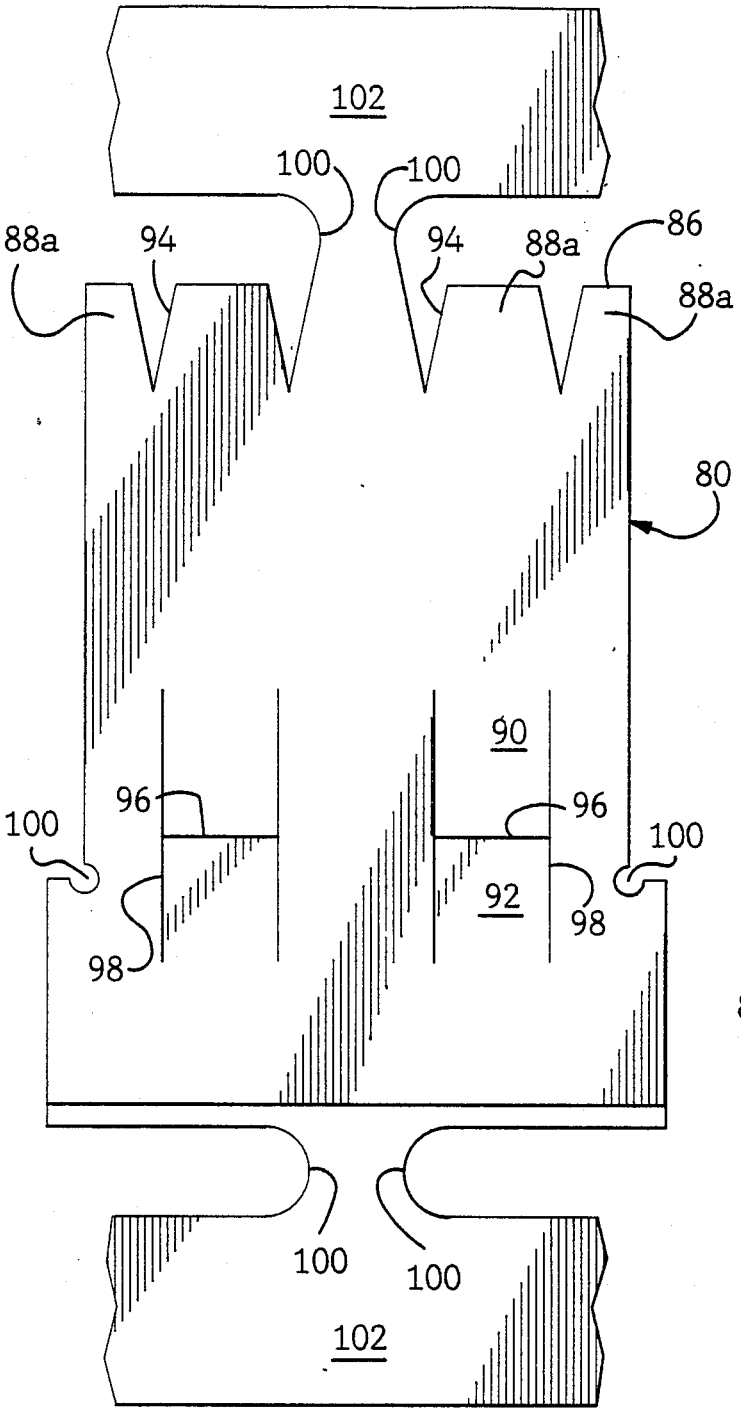
FIG. 4A is a plan view of the flat blank from which the pin of FIG. 1 is formed.

FIG. 4A is a plan view of stamped blank 20 from which pin 12 is formed. The V-shaped cut-outs 94 shown at front end 86 of mating portion 80 define nose sections **88*a* which permit the forming of bullet-shaped nose 88. Ears 90 and wire stops 92 are defined by orthogonal slits 96,98. Circular cut-outs 100 are provided at the interface between portions 80–82 to facilitate the forming of pin 12**.

Reference numerals 102 indicated portions of the carrier strip which carries a given item; e.g., pin 12, through the various stamping and forming work stations (not shown).

Figure 4B:
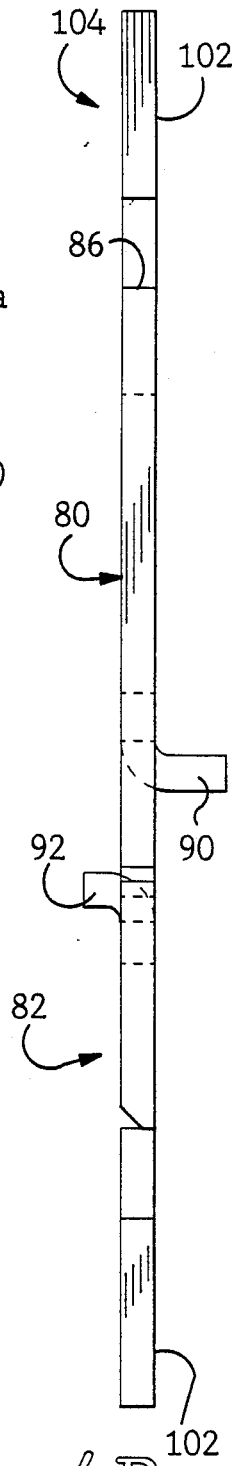
FIG. 4B is a side view of the blank of FIG. 4A.

FIG. 4B is a side view of partially formed blank 104 from which pin 12 is formed. As shown ears 90 and wire stops 92 have been turned outwardly.

Forming pin 12 is a matter of offsetting wire barrel 82, rolling that blank (not shown) into a cylindrical shape and curving in nose sections 88*a* to form nose 88.

As is apparent from the above description, socket 10 and pin 12 can be very economically produced, particularly relative to screw machining.

In use, wires 14,16 are secured into respective barrels 26,82 with respective wire stops 62,92 insuring proper wire insertion depth. As pin 12 is inserted into receptacle portion 22 of socket 10, beams 34 are resiliently forced out for the reason that the diameter of receptacle portion 22 in the vicinity of convex surfaces 54 is smaller than the diameter of mating portion 80 of pin 12. Accordingly, convex surfaces 54 in particular exert a compressive force against mating portion 80 to provide a good electrical contact. As shown in FIG. 2, insertion depth of pin 12 is pre-determined by ears 90 abutting front end 30 of socket 10.

Rearwardly facing free ends 42*b*, 52*b* of beams 34*b* and 34*c* respectively cooperated with ears 60 to retain socket 10 in housing (not shown) in a known manner. Similarly, ears 90 can provide the same feature for pin 12 if desired.

As can be discerned, an electrical socket and pin has been disclosed which is economically manufactured by stamping and forming. The socket includes a mating portion having a flared opening leading to convex contact surfaces. The resilient beams comprising the mating portion provide normal forces against the inserted pin for good electrical contact.

I claim:

1. An electrical pin and socket connector for electrically interconnecting a pair of wires, comprising:

a socket made by stamping and forming and having a cylindrical receptacle portion at one end, a connecting section extending rearwardly therefrom and a wire barrel attached to and extending from said connecting section, said receptacle portion being defined by a plurality of axially extending resilient, cantilever beams having inwardly facing convex surfaces adjacent a pin receiving opening to the receptacle portion; and a pin made by stamping and forming and having a cylindrical mating portion at one end and a wire barrel at another end, said mating portion having a bullet nose, insertion limiting ears extending outwardly from opposite sides thereof for cooperative engagement with said cylindrical receptacle portion and an outer diameter slightly greater than the inner diameter of the convex surfaces of the receptacle portion, said mating portion being slidably received in the receptacle portion to electrically interconnect wires which may be terminated in the respective wire barrels, said wire barrel of said pin having wire stopping ears extending interiorly from opposite sides thereof.

2. The connector of claim 1 wherein the wire stopping ears and insertion limiting ears on each of the opposite sides of said pin are defined by common orthogonal slits.

3. The connector of claim 1 wherein each of said beams include at least two blades defined by a slot therebetween and with one of said blades being attached to the connecting section and with the other blade being free therefrom.

4. The connector of claim 3 wherein said blades join together towards the pin-receiving opening.

5. The connector of claim 1 wherein the wire barrel on the socket extends normally outwardly.

6. The connector of claim 5 further including wire stop means extending inwardly from the connecting section of the socket and projecting axially towards the wire barrel.

* * * * *